US006666162B2

(12) United States Patent
Allison

(10) Patent No.: US 6,666,162 B2
(45) Date of Patent: Dec. 23, 2003

(54) ALUMINUM HULL BOAT WITH EXTRUDED RUNNING SURFACE

(76) Inventor: Darris E. Allison, 106 Main St., Louisville, TN (US) 37777

( * ) Notice: Subject to any disclaimer, the term of this patent is extended or adjusted under 35 U.S.C. 154(b) by 0 days.

(21) Appl. No.: 09/887,192

(22) Filed: Jun. 21, 2001

(65) Prior Publication Data

US 2001/0047747 A1 Dec. 6, 2001

(51) Int. Cl.[7] ..... B63B 3/00
(52) U.S. Cl. ..... 114/355; 114/356; 114/271
(58) Field of Search ..... 114/355–359, 364, 114/271, 288, 56.1, 61.32, 61.33, 63

(56) References Cited

U.S. PATENT DOCUMENTS

| | | | | | |
|---|---|---|---|---|---|
| 2,684,489 | A | * | 7/1954 | Porter, Jr. | 114/356 |
| 3,226,739 | A | * | 1/1966 | Noe | 114/355 |
| 3,262,301 | A | * | 7/1966 | Langworthy | 72/296 |
| 3,742,745 | A | * | 7/1973 | Swenson, Sr. | 72/54 |
| 4,004,542 | A | * | 1/1977 | Holmes | 114/38 |
| 4,128,072 | A | * | 12/1978 | Wood, Jr. | 114/291 |
| 4,214,332 | A | * | 7/1980 | Stoner | 114/356 |
| 4,458,623 | A | | 7/1984 | Lovqvist | |
| 4,584,959 | A | | 4/1986 | Allison | |
| 4,903,626 | A | | 2/1990 | Haines | |
| 5,349,917 | A | * | 9/1994 | May | 114/347 |
| 5,676,080 | A | * | 10/1997 | Allen | 114/65 R |
| 5,983,823 | A | | 11/1999 | Allison | |
| 6,145,466 | A | * | 11/2000 | Herbein et al. | 114/356 |
| 6,182,591 | B1 | * | 2/2001 | Whitesides et al. | 114/83 |
| 6,216,622 | B1 | * | 4/2001 | Lindstrom et al. | 114/61.33 |
| 6,223,674 | B1 | * | 5/2001 | Wyman et al. | 114/271 |
| 6,354,236 | B1 | * | 3/2002 | Davidson | 114/271 |
| 6,394,014 | B1 | * | 5/2002 | Waldock | 114/61.1 |

FOREIGN PATENT DOCUMENTS

| | | | | |
|---|---|---|---|---|
| EP | 213107 | * | 3/1987 | 114/61.33 |
| JP | 58-112889 | * | 7/1983 | 114/61.33 |
| JP | 05-085461 | * | 4/1993 | 114/356 |
| WO | WO 9411237 | * | 5/1994 | 114/356 |

* cited by examiner

*Primary Examiner*—S. Joseph Morano
*Assistant Examiner*—Ajay Vasudeva
(74) *Attorney, Agent, or Firm*—Luedeka, Neely & Graham, P.C.

(57) ABSTRACT

An aluminum hull boat includes a running pad formed through an extrusion process. The running pad includes a lower planing element at least a portion of which is in contact with the water when the boat is at planing speed, and opposed sidewalls which attach the running pad to the boat's undersurface. The extrusion process efficiently produces a running pad that is highly rigid and uniform with relatively sharp outer edges that allow water migrating from beneath the running pad to break cleanly off and away from the running pad, thereby eliminating hydrodynamic drag and improving the boat's performance characteristics.

15 Claims, 4 Drawing Sheets

ALUMINUM HULL BOAT WITH EXTRUDED RUNNING SURFACE

BACKGROUND

1 . Field of the Invention

The present invention relates generally to aluminum hull boats. More particularly, the present invention relates to an extruded aluminum running surface for improving the performance of aluminum hull boats.

2 . Background of the Invention

In the process of manufacturing aluminum hull boats, the boat hull is typically bent and formed to a desired shape with the use of a hydraulically actuated press break. As the press break bends the aluminum metal to form the running surfaces, strakes, and other hull structure, the metal inherently forms a rounded corner where it is bent. Water will naturally flow in the direction of least resistance. During high speed operation of the boat as water migrates outwardly from beneath the boat's running surfaces, the rounded corners defining the running surface edges allow the water to remain in contact with the boat as the water follows the low resistive path along the curved edge. This process results in hydrodynamic drag which reduces the boat's performance characteristics, including speed, fuel efficiency, range, hole shot performance, and manueverability.

Therefore, there is a need for an improved aluminum running surface, and method of manufacturing the same, for an aluminum hull boat.

SUMMARY OF THE INVENTION

The present invention eliminates the difficulties and disadvantages of the prior art by providing an aluminum boat hull having a bow, a transom, a centerline, and an undersurface in contact with the water when the boat is at rest. The boat hull includes an aluminum running pad fabricated by a process of extrusion. The running pad includes a lower planing element extending from a first end to a second end. At least a portion of the lower planing element is in contact with the water when the boat is at planing speed. The lower planing element is further defined by opposed first and second lateral edges, which are preferably parallel with the boat centerline and symmetrically offset therefrom. The running pad further includes a pair of sidewalls extending from the lateral edges to the boat's undersurface. During the extrusion process, the lower planing element and the sidewalls are efficiently formed as a single extruded aluminum part with the lower planing element transitioning sharply to the sidewalls at the lateral edges. The boat hull also includes a lower hull surface outboard of the lateral edges of the running pad. Portions of the lower hull surface are above the water when the boat is at planing speed.

As mentioned above, the extrusion process produces a running surface with relatively sharp lateral edges. These sharp edges allow water migrating from beneath the lower planing element to break cleanly away from the edges, resulting in reduced hydrodynamic drag and improved boat performance. In a preferred embodiment, the lateral edges have a radius of curvature of less than about forty thousands of an inch (0.040 inches).

The lower planing element may be formed with a slight Vee angle. The Vee angle could be centered along the boat's centerline and become progressively deeper at the second end of the running surface. The Vee angle can become progressively deeper starting at the first end of the running surface, or the contour of the running surface may remain unchanged for some distance from the first end before becoming progressively deeper.

The present invention also provides a method for manufacturing an aluminum boat with a bow, a transom, a centerline, and an undersurface in contact with the water when the boat is at rest. The method includes extruding an aluminum running pad like that described above, and attaching the extruded aluminum running pad to the boat's undersurface with the lateral edges substantially parallel with the boat centerline and symmetrically offset therefrom.

BRIEF DESCRIPTION OF THE DRAWINGS

Preferred embodiments of the invention will now be described in further detail. Other features, aspects, and advantages of the present invention will become better understood with regard to the following detailed description, appended claims, and accompanying drawings (which are not to scale) where:

DETAILED DESCRIPTION OF THE PREFERRED EMBODIMENT(S)

Figure 1:
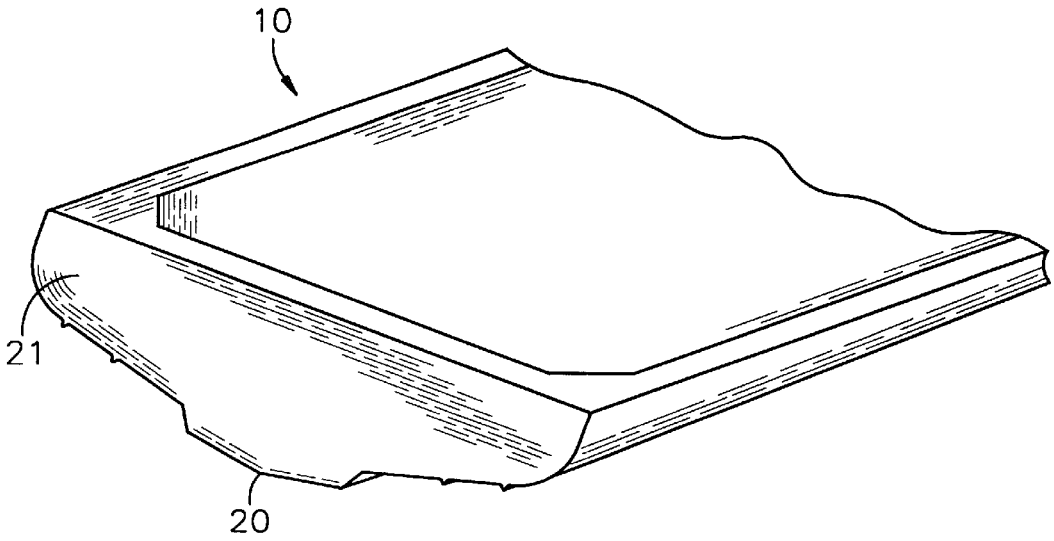
FIG. 1 is a perspective sectional view of an aluminum hull boat employing an extruded aluminum running surface in accordance with the invention.
Figure 2:
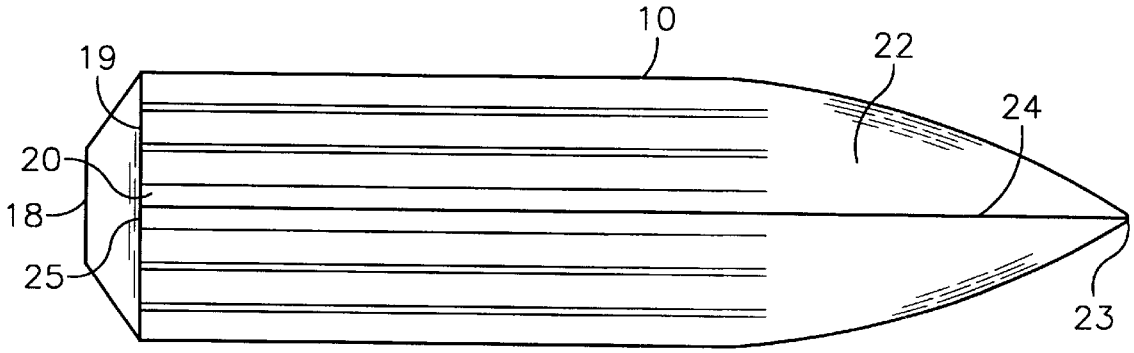
FIG. 2 is a bottom plan view of an aluminum boat having an offset transom employing an extruded running surface in accordance with the invention.

With reference now to the drawings in which like reference characters designate like or similar parts throughout the several views, FIG. 1 illustrates an aluminum hull boat 10 with a substantially horizontal, extruded aluminum running surface 20 in accordance with the invention. The horizontal running surface 20 includes that portion of the boat's undersurface which is in contact with the water when the boat 10 is at planing speed (also sometimes referred to in the art as the "pad"). FIG. 2 provides a bottom view of an aluminum hull boat 10 having an offset transom 18 with the extruded aluminum running surface 20 more clearly shown in plan view. As can be seen, the running surface 20 has an aft end which, for a boat having no offset transom (FIG. 1) is preferably adjacent the boat transom 21 and extends forwardly toward the boat bow 23 for at least a portion of the length of the boat 10. For a boat having an offset transom (FIG. 2), the running surface aft end 25 is positioned forward of the transom 18 adjacent step 19. The particular boat 10 shown in FIGS. 1 and 2 is an aluminum hull bass boat, but the extruded aluminum running surface 20 can be supplied on a variety of boat hull types including multi-hull boats such as tunnel-type boats, pontoon boats, catamarans, and trimarans.

The running surface 20 is efficiently fabricated by a process of extrusion to obtain desired hydrodynamic properties. During fabrication, raw aluminum material is extruded through a die (which is essentially a metal block with a through opening having the same cross-sectional dimensions as the extruded running surface) to produce a running surface 20 of the general configuration shown in FIG. 3. However, the invention is not limited to the particular configuration of running surface shown in FIG. 3—it being understood that other shapes and configurations of a running surface 20 can be obtained through a process of extrusion without departing from the invention.

Figure 4:
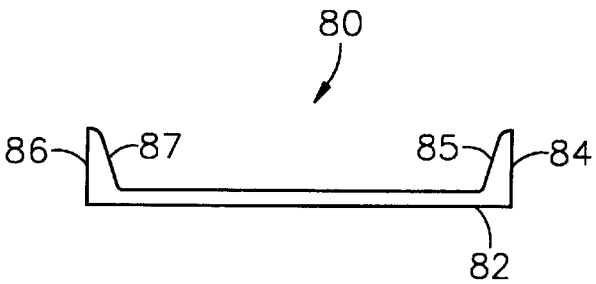
FIG. 4 is a side view of an alternate configuration of an extruded aluminum running surface according to the invention.
Figure 5:
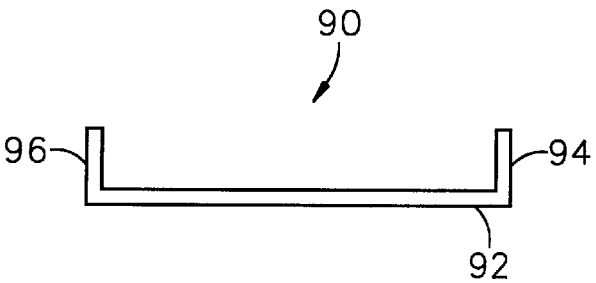
FIG. 5 is a side view of another alternate configuration of an extruded aluminum running surface according to the invention.

For example, FIG. 4 shows an alternate configuration of a running surface 80 having a more generally rectangular shape and being totally flat on the lower planing surface 82 with no Vee angle. The sidewalls 84, 85 include an inward tapered surface 85, 87 for added strength. FIG. 5 shows a square channel configuration of a running surface 90 with a totally flat lower planing surface 92 and sidewalls 94, 96 with no inward tapered surface. The running surfaces shown in FIGS. 4 and 5 can be simply welded to the bottom of an existing aluminum hull boat, such as an aluminum jon boat and the aluminum pontoons of a pontoon boat, to enhance the boat's performance characteristics. If desired, the extruded channels shown in FIGS. 4 and 5 can be ordered from metal suppliers as a structural aluminum channel and then simply welded to the bottom of a boat.

In a preferred embodiment, the elongate running surface 20 is cut to the desired length (typically between about 5–10 feet) and then blended with the undersurface 22 (FIG. 2) of a monohull boat 10, for example, to provide a geometrically smooth transition from the running surface 20 to the Vee section 24 of the bow of the boat 10. In a preferred embodiment, an eight-foot section of running surface is cut from the running surface extrusion (see FIG. 3) and then placed in a press break. The press break leaves the aft four feet of the running surface unchanged, but shapes the forward four feet of the running surface extrusion into a progressive Vee shape going forward to match the Vee in the bow of the boat 10, or the press break may act to form a progressive Vee shape from the aft end of the running surface to the forward end. In an alternative method of fabrication, the extruded running surface 20 is not placed in a press break, but instead, is left in the configuration shown in FIG. 3 and the boat's undersurface 22 is fabricated so as to have a progressively decreasing Vee going aft to match the shape of the running surface 20.

Figure 3:
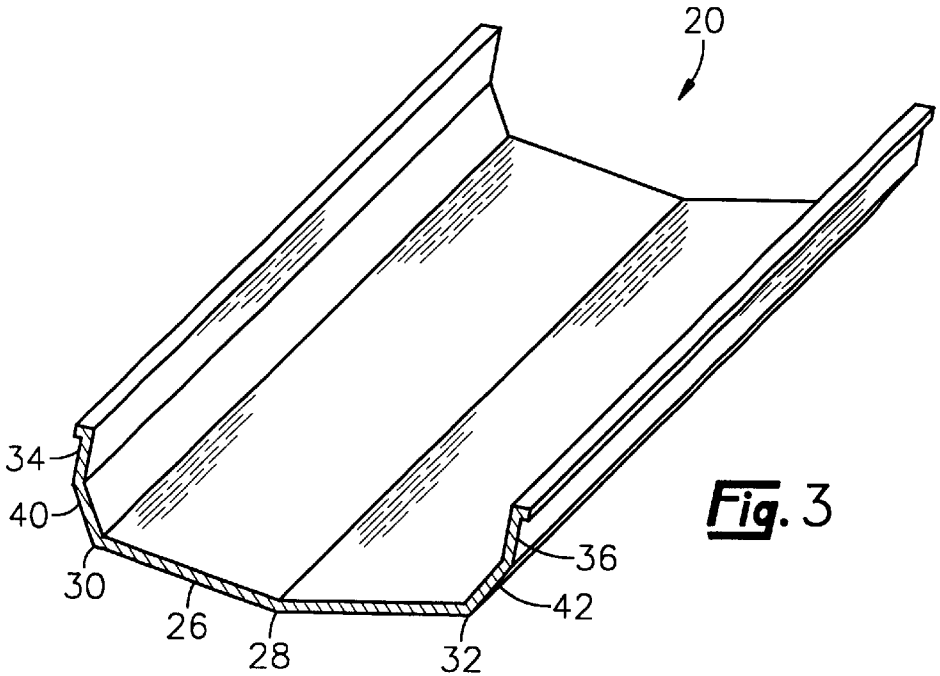
FIG. 3 is an elevated cross-sectional view of an extruded aluminum running surface according to the invention.
Figure 6:
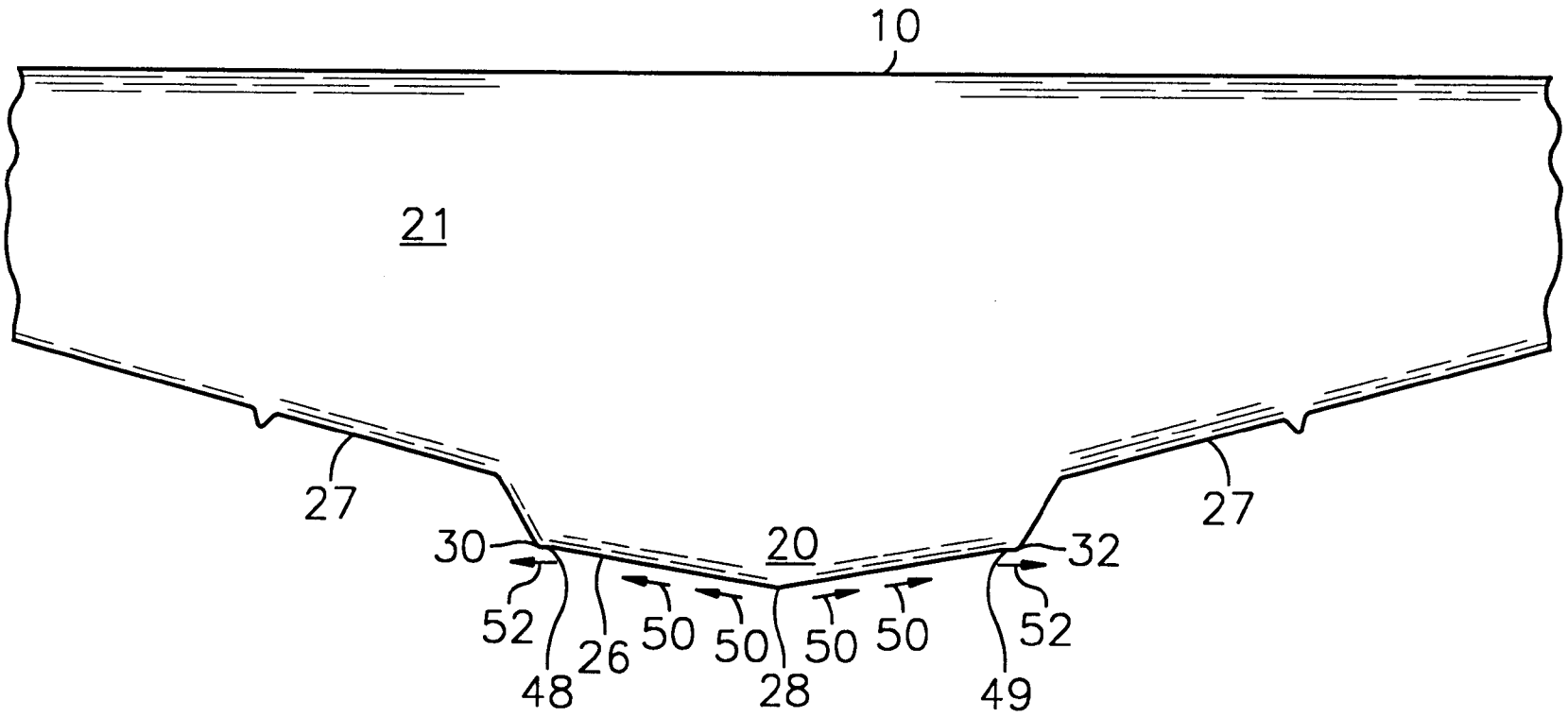
FIG. 6 is a rear sectional view of the boat of FIG. 1.

As shown in FIGS. 3 and 6, a preferred embodiment of the running surface 20 includes a lower planing portion 26 having a slight Vee 28 at the centerline which is preferably formed during extrusion but may alternatively be formed by use of a press break. The lower planing portion 26 is further defined by lateral outer edges 30, 32 which, for a monohull boat 10 as shown in FIGS. 1 and 2, are substantially parallel with the boat hull centerline and symmetrically offset therefrom. For boats having a hull which is not symmetrical (such as certain types of multi-hull boats), the outer edges 30, 32 may not be symmetrical with respect to the boat hull centerline.

At the opposing outer edges 30, 32 of the lower planing portion 26 are respective sidewalls 34, 36. In a preferred embodiment, each of the sidewalls 34, 36 includes a lower portion 40, 42 which is slightly offset from the remaining upper portion of the sidewall 34, 36. This slight offset acts to enhance the boat's manueverability. However, it will be understood that the entire height of the sidewalls 34, 36 can be straight with no offset portions if desired.

With reference now to FIG. 6, in operation as the boat 10 is traveling through the water, water is forced from the Vee centerline 28 outwardly toward the outer edges 30, 32 of the lower planing portion 26 as generally indicated by arrows 50. The Vee helps to split the water for a smoother ride. The outer edges 30, 32, having been formed through a process of extrusion, provide a sharp transition with a relatively small radius of curvature (preferably no greater than about forty thousandths of an inch—0.040 inches—but nominally about 0.020 inches). As water travels over the outer edges 30, 32 (shown by arrows 52), the water breaks cleanly off the lower portion 26 and, resultingly, creates little or no hydrodynamic drag once the water has traveled past the outer edges 30, 32. By comparison, an aluminum running surface formed by use of a press break would have outer edges with a relatively large radius of curvature (typically about double the thickness of the aluminum) that allows water to remain in contact with the boat 10 by clinging to and following the curved edges upwardly and aftly along a portion of the sidewalls before falling off, thereby creating hydrodynamic drag which compromises the boat's performance characteristics, including acceleration, top speed, fuel efficiency, range, manueverability, and hole shot performance. The sharp outer edges 30, 32, by allowing water to break cleanly away from the running surface 20, also reduces the amount of wetted area of those portions of the boat's undersurface 27 which are outboard of the running surface 20, thereby further reducing hydrodynamic drag. Preferably, the outermost sections 48, 49 of the lower portion 26 adjacent outer edges 30, 32 are flat to further enhance the ability of the water to break cleanly past the outer edges 30, 32.

Other advantages of the present invention can be appreciated by a more complete understanding of typical methods of aluminum boat construction. Aluminum boat manufacturers typically use aluminum sheets of about one tenth of an inch (0.100 inches) in thickness to form the boat's undersurface, including the boat's running surfaces. When an aluminum sheet of 0.100 inch thickness is placed in a press break and bent to form the boat's running surface, the resulting radius at the running surface edges will necessarily be greater than 0.100 inches (and will typically be about double the thickness of the metal as previously discussed). The radius at the bent edges can be reduced somewhat by using a thinner metal sheet, but the negative effect will be a loss in structural rigidity and strength. By using an extrusion process to form the boat's running surface, the running surface can be made significantly thicker with no resultant negative effect at the running surface edges. For example, in a preferred embodiment of the invention, the running surface is about 0.250 inches thick and the running surface edges have a radius of curvature of about 0.020 inches. An aluminum running surface having this level of structural rigidity and performance characteristics is unobtainable through current boat construction practices.

It will also be appreciated that when a relatively thin aluminum metal sheet (such as a 0.100 inch thick sheet) is welded to another relatively thin aluminum metal sheet in accordance with current aluminum boat hull construction practices, heat from the welding process warps the aluminum sheets. The warped undersurface of the boat increases hydrodynamic drag and reduces the boat's top speed and other performance characteristics. Since an aluminum running surface in accordance with the present invention can be made significantly thicker (preferably about 0.250 inches thick) through the extrusion process, the extruded running surface will experience little or no warping when welded. This in turn enhances the boat's performance characteristics through reduced hydrodynamic drag.

A still further advantage of the present invention is that the extrusion process results in a running surface that is exceptionally straight and uniform from end to end, which further enhances the boat's performance characteristics through reduced hydrodynamic drag.

Figure 7:
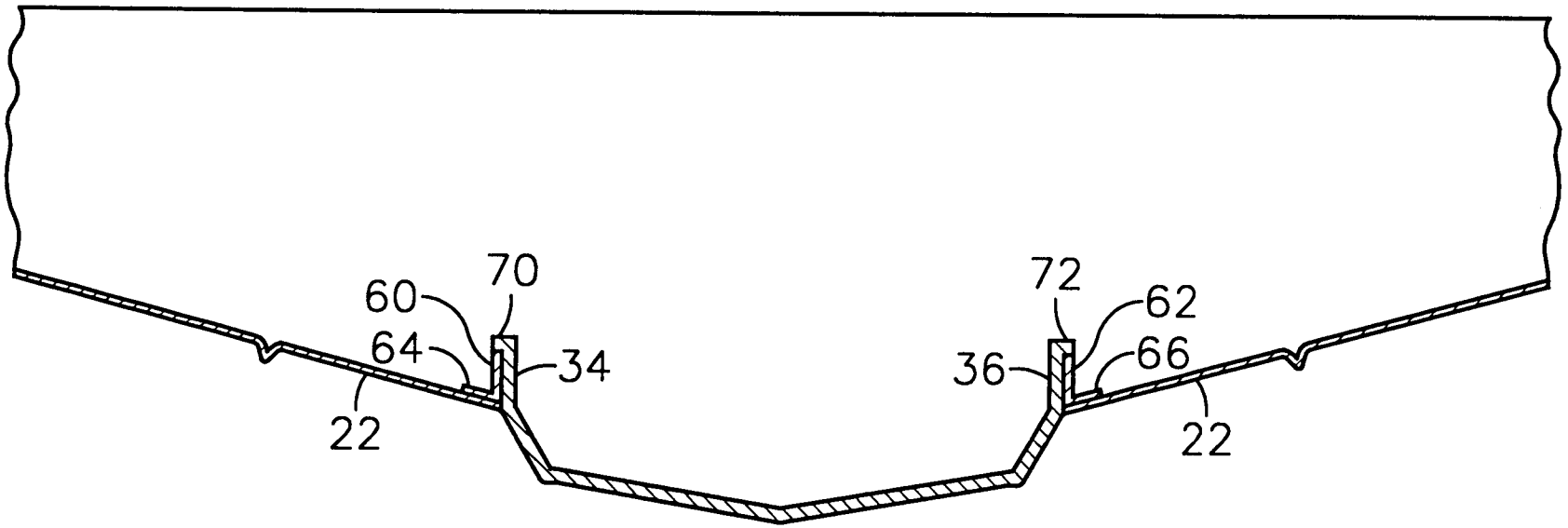
FIG. 7 is a rear cross-sectional view of a an aluminum hull boat showing assembly structure for an extruded running surface in accordance with the invention.

The extruded running surface 20 may be structurally attached to the boat 10 using various techniques. In a preferred embodiment, brackets 60, 62 (preferably having the same length as the running surface 20) are employed to facilitate attachment of the running surface 20 to the boat 10 as shown in FIG. 7. Each bracket includes a vertical portion 60, 66 attached adjacent a sidewall 34, 36 of the running surface 20. Each bracket 60, 62 also includes an angled portion 64, 66 which is attached adjacent the boat's undersurface 22. Preferably, the brackets 60, 62 are attached by welding, but they may also be attached by use of rivets or other fasteners. The upper ends of the running surface walls 34, 36 include a lip or flange 70, 72 which preferably runs the length of the running surface 20 (see FIG. 3). The flange 70, 72 engages the upper edge of a respective bracket 60, 62 and enhances structural integrity. However, it will be appreciated that an extruded aluminum running surface 20 may be structurally attached to the boat 10 using other techniques, such as by simply welding the running surface 20 to the bottom of the boat 10 as described previously.

While the invention has been described in detail, it is to be expressly understood that it will be apparent to persons skilled in the relevant art that the invention may be modified without departing from the spirit of the invention. Various changes of form, design or arrangement may be made to the invention without departing from the spirit and scope of the invention. Therefore, the above mentioned description is to be considered exemplary, rather than limiting, and the true scope of the invention is that defined in the following claims.

What is claimed is:

1. An aluminum boat hull having a bow, a transom, a centerline, and an undersurface in contact with the water when the boat is at rest, said boat hull comprising:

an extruded aluminum running pad for lifting the boat as the boat moves through the water, said running pad having a lower planing element extending from a first end to a second end, at least a portion of the lower planing element being in contact with the water when the boat is at planing speed, said lower planing element further defined by opposed first and second lateral edges;

a first sidewall extending from the first lateral edge to the undersurface;

a second sidewall extending from the second lateral edge to the undersurface and a lower hull surface outboard of the lateral edges of said running pad, said lower hull surface including portions being above the water surface when the boat is at planing speed;

wherein said lower planing element and said first and second sidewalls are formed as a single extruded aluminum part with the lower planing element transitioning sharply to the first and second sidewalls at the lateral edges so as to enhance the ability of water to break cleanly away from the lower planing element and thereby reduce the amount of wetted area of said lower hull surface when the boat is at planing speed.

2. A boat hull according to claim 1 wherein said first and second lateral edges include a radius of curvature less than about forty thousandths of an inch (0.040 inches).

3. A boat hull according to claim 1 wherein said lower planing element includes a slight Vee angle beginning at the first end of the running pad and extending toward the second end.

4. A boat hull according to claim 3 wherein said lower planing element includes a planing element centerline at the Vee angle, said planing element centerline defining at least a portion of the boat hull centerline.

5. A boat hull according to claim 3 wherein said Vee angle terminates at opposed first and second flat surfaces adjacent the first and second lateral edges.

6. A boat hull according to claim 1 wherein said lower planing element is flat.

7. A boat hull according to claim 1 wherein said first and second lateral edges are substantially parallel to the boat hull centerline.

8. An aluminum boat hull having a bow, a transom, a centerline, and an undersurface in contact with the water when the boat is at rest, said boat hull comprising:

a substantially horizontal extruded aluminum running pad for lifting the boat as the boat moves through the water, said running pad having a lower planing element extending from a first end adjacent the transom to a second end, at least a portion of the lower planing element being in contact with the water when the boat is at planing speed, said lower planing element further defined by opposed first and second lateral edges substantially parallel with the boat centerline and symmetrically offset therefrom;

a first sidewall extending from the first lateral edge to the undersurface;

a second sidewall extending from the second lateral edge to the undersurface; and a lower hull surface outboard of the lateral edges of said running pad, said lower hull surface including portions being above the water surface when the boat is at planing speed;

wherein said lower planing element and said first and second sidewalls are formed as a single extruded aluminum part with the lower planing element transitioning sharply to the first and second sidewalls at the lateral edges to enhance the ability of water to migrate past the lateral edges and thereby eliminate hydrodynamic drag by reducing the amount of wetted area of said lower hull surface.

9. A boat hull according to claim 8 wherein said first and second lateral edges include a radius of curvature less than about forty thousandths of an inch (0.040 inches).

10. A boat hull according to claim 8 wherein said lower planing element includes a slight Vee angle beginning at the first end of the running pad and extending toward the second end.

11. A boat hull according to claim 10 wherein said lower planing element includes a planing element centerline at the Vee angle, said planing element centerline defining at least a portion of the boat hull centerline.

12. A boat hull according to claim 10 wherein said Vee angle terminates at opposed first and second flat surfaces adjacent the first and second lateral edges.

13. A method for manufacturing an aluminum boat with a bow, a transom, a centerline, and an undersurface in contact with the water when the boat is at rest, the method comprising:

extruding an aluminum running pad for lifting the boat as the boat moves through the water, said running pad having opposed first and second ends and a lower planing element with opposed lateral edges which transition sharply to corresponding sidewalls, at least a portion of said lower planing element being in contact with the water when the boat is at planing speed; and attaching the extruded running pad to the boat undersurface with the lateral edges substantially parallel with the boat centerline and symmetrically offset therefrom so as to enhance the ability of water to migrate past the lateral edges of the lower planing element and thereby reduce the amount of wetted area of the boat undersurface outboard of the running pad when the boat is at planing speed.

14. The method of claim 13 further comprising forming the lateral edges of the lower planing element with a radius of curvature less than about forty thousandths of an inch (0.040 inches).

15. The method of claim 13 further comprising:

attaching the first end of the running pad adjacent the transom; and forming the lower planing element with a shallow Vee angle.

* * * * *